US009464385B2

(12) United States Patent
Rosset

(10) Patent No.: US 9,464,385 B2
(45) Date of Patent: Oct. 11, 2016

(54) MULTI-LAYER SECURITY PAPER

(75) Inventor: Henri Rosset, Le Pin (FR)

(73) Assignee: ARJOWIGGINS SECURITY, Boulogne-Billancourt (FR)

( * ) Notice: Subject to any disclaimer, the term of this patent is extended or adjusted under 35 U.S.C. 154(b) by 1053 days.

(21) Appl. No.: 10/575,367

(22) PCT Filed: Oct. 15, 2004

(86) PCT No.: PCT/FR2004/002631
§ 371 (c)(1),
(2), (4) Date: Nov. 22, 2011

(87) PCT Pub. No.: WO2005/038135
PCT Pub. Date: Apr. 28, 2005

(65) Prior Publication Data

US 2007/0128418 A1 Jun. 7, 2007

(30) Foreign Application Priority Data

Oct. 15, 2003 (FR) ..... 03 12020

(51) Int. Cl.

| | |
|---|---|
| ***B42D 25/30*** | (2014.01) |
| ***B42D 25/40*** | (2014.01) |
| ***D21H 21/40*** | (2006.01) |
| *D21H 11/20* | (2006.01) |
| *D21H 13/10* | (2006.01) |

(Continued)

(52) U.S. Cl.
CPC ..... *D21H 21/40* (2013.01); *B42D 25/30* (2014.10); *B42D 25/40* (2014.10); *D21H 11/20* (2013.01); *D21H 13/10* (2013.01); *D21H 21/18* (2013.01); *D21H 27/30* (2013.01); *Y10T 428/24942* (2015.01)

(58) Field of Classification Search
USPC ..... 283/72, 81, 91, 94–95, 100–101, 107, 283/109–111, 114; 428/916, 449; 162/123–132
See application file for complete search history.

(56) References Cited

U.S. PATENT DOCUMENTS 1,687,140 A 10/1928 Pleyer
3,451,878 A * 6/1969 Doughty et al. ..... 162/126

(Continued)

FOREIGN PATENT DOCUMENTS

CA 2313162 A1 4/2000
DE 43 14 380 11/1994

(Continued)

OTHER PUBLICATIONS

Norton Pulp and Paper Research Journal vol. 15 No. May 2000: See attached PDF.*

(Continued)

*Primary Examiner* — Kyle Grabowski
(74) *Attorney, Agent, or Firm* — Westerman, Hattori, Daniels & Adrian, LLP

(57) ABSTRACT

The invention relates to a security paper consisting of at least two paper fiber webs, wherein the first web is embodied in the form of an external we provided with at least one authentication element and the second web comprises a reinforcing element which is substantially absent in the first web and selected amongst materials improving mechanical strength, and/or another authentication element and the authentication element of said first web substantially absent in the second web. A method for producing the inventive security paper is also disclosed.

28 Claims, 1 Drawing Sheet

(51) Int. Cl.

| | |
|---|---|
| *D21H 21/18* | (2006.01) |
| *D21H 27/30* | (2006.01) |

(56) References Cited

U.S. PATENT DOCUMENTS

| | | | | |
|---|---|---|---|---|
| 3,880,706 | A * | 4/1975 | Williams | 162/103 |
| 4,496,961 | A * | 1/1985 | Devrient | 162/126 |
| 4,534,398 | A * | 8/1985 | Crane | 162/123 |
| 4,552,617 | A * | 11/1985 | Crane | 162/103 |
| 4,629,630 | A * | 12/1986 | Devrient | 162/126 |
| 4,720,325 | A * | 1/1988 | Rausing et al. | 162/110 |
| 4,820,912 | A | 4/1989 | Samyn | |
| 4,921,280 | A * | 5/1990 | Jalon | 283/92 |
| 5,161,829 | A * | 11/1992 | Detrick et al. | 283/91 |
| 5,449,200 | A * | 9/1995 | Andric et al. | 283/91 |
| 5,565,276 | A * | 10/1996 | Murakami et al. | 428/537.5 |
| 5,783,275 | A | 7/1998 | Muck et al. | |
| 5,961,432 | A * | 10/1999 | Murakami et al. | 493/187 |
| 6,402,888 | B1 * | 6/2002 | Doublet et al. | 162/140 |
| 6,491,324 | B1 * | 12/2002 | Schmitz et al. | 283/82 |
| 2002/0112830 | A1 * | 8/2002 | Bakken et al. | 162/123 |
| 2002/0127940 | A1 | 9/2002 | Ruhrig | |
| 2004/0239097 | A1 | 12/2004 | Boehm et al. | |

FOREIGN PATENT DOCUMENTS

| | | | |
|---|---|---|---|
| EP | 0 229 645 | | 7/1987 |
| EP | 0229645 | A1 | 7/1987 |
| EP | 0 453 131 | | 10/1991 |
| EP | 0 666 182 | A1 | 8/1995 |
| EP | 1036665 | A1 | 9/2000 |
| EP | 1070599 | A1 | 1/2001 |
| EP | 1687484 | B1 | 12/2010 |
| FR | 1 476 444 | | 4/1967 |
| FR | 2 741 089 | | 5/1997 |
| GB | 437969 | A | 11/1935 |
| GB | 469023 | B | 7/1937 |
| GB | 1276329 | A | 6/1972 |
| WO | WO 98/51861 | | 11/1998 |
| WO | 00-15903 | A1 | 3/2000 |
| WO | WO 00/32874 | | 6/2000 |
| WO | 03-029003 | A1 | 4/2003 |

OTHER PUBLICATIONS

International Search Report of PCT/FR2004/002631 dated Mar. 14, 2005.

Renesse, Rudoff L. van; "Optical Document Security", Second Edition, Artech House Optoelectronics Library, Boston, US—London, UK, pp. 10-11 (1998), in English, D8 cited in Opposition dated Oct. 5, 2011, in corresponding European Application No. 04791542.6.

Klungness et al; "Lightweight, high-opacity paper by fiber loading: filler comparison"; Nordic Pulp and Paper Research Journal vol. 15, No. 5, pp. 345-350 (2000), in English, D9 cited in Opposition dated Oct. 5, 2011, in corresponding European Application No. 04791542.6.

Goettsching, Lothar, "Papier in unserer Welt—Ein Handbuch," ECON-Verlag GmbH, Duesseldorf, pp. 145-151 (1990), D5 cited in Opposition dated Oct. 5, 2011, in corresponding European Application No. 04791542.6. (with English translation of portion of opposition citing this reference).

Notice of Opposition dated Oct. 4, 2011 in corresponding European Application No. 04791542.6 (statement of grounds in English, listing D1-D12).

Notice of Opposition dated Oct. 5, 2011 in corresponding European Application No. 04791542.6. (statement of grounds listing D1-D9).

Letter from opponent dated Sep. 30, 2013 in opposition procedure of counterpart EP application No. EP1687484 (in English; 5 pages).

Interlocutory decision dated Nov. 28, 2013 in opposition procedure of counterpart EP application No. EP1687484 (with English machine translation; 55 pages).

Decision dated Jul. 10, 2014 to maintain patent as amended, with amended claims, in opposition procedure of counterpart EP application No. EP1687484 (with English machine translation; 5 pages).

* cited by examiner

MULTI-LAYER SECURITY PAPER

BACKGROUND ART

The present invention relates to a security paper and more particularly to a security paper used in particular for the manufacture of banknotes, passports, certificates of authenticity and checks.

The invention also relates to a process for manufacturing said security paper.

Very many printed documents require increasing means for ensuring their authentication and their security protection.

These documents range from banknotes to travel documents, and also include scratchcards, playing cards, checks, identity cards and passports.

To allow the user or holder of the security document to check the authenticity of the document in a simple and reliable manner, it is common practice to include authentication elements within the thickness of the constituent material of the document.

Under certain specific conditions, these elements emit signals that can be detected, generally with the eye, the observation of said signals revealing the presence of said elements within the document and, consequently, guaranteeing its authenticity.

The inclusion of such elements is also designed to prevent malintentioned persons from counterfeiting said document by reproducing, identically or almost identically, the characteristics of said document.

The suppliers of security documents, aware of an increase in the level of expertise and organization of potential counterfeiters in this field, have in recent years envisaged increasing the number and variety of the authentication elements present within any one security document.

The solutions envisaged in this regard do however have certain problems.

Firstly, the possibility of reproducing, identically or almost identically, the security document is not fundamentally reduced owing to these further additions of security elements.

A counterfeiter, sufficiently patient and correctly equipped, is in fact capable of discovering the nature and the exact quantity of the elements constituting the document to be counterfeited.

By reproducing the steps for obtaining the document, which steps have not been modified, it is not impossible to end up with an almost perfect reproduction of the document in question.

Secondly, it may turn out that this solution does not actually meet the requirements of users in this field.

In fact, the customary user rarely checks all of the security elements present in a given document.

Only the most easily and directly detectable elements are checked by him.

In the case of a banknote for example, these are generally the watermark or certain colored fibers or iridescent particles visible to the naked eye.

Lastly, the presence of an increasing number of security protection elements within the same base structure may result in impediments between security protection elements having mutually incompatible physical properties.

Thus, in the case of banknotes, it is sometimes necessary to opacify the fibrous material so as to increase the rendition and contrast of the watermark.

This opacification may then make it harder to see the other particles or fibers intended for authentication.

Only the particles or fibers located on the surface of the banknote will be visible, the others being embedded in the opaque fibrous layer.

U.S. Pat. No. 5,565,276 describes a security paper that can be formed from a first ply of paper and from a second ply with a smaller weight than that of the first ply and containing iridescent planchettes as authentication element. The object of that patent is to improve the visibility of the planchettes.

However, it remains necessary to further improve the security protection of security documents and/or their mechanical strength.

SUMMARY OF THE INVENTION

It is one of the objects of the invention therefore to propose a security paper allowing the level of security protection of said documents to be increased while avoiding these problems of the prior art.

In parallel or in conjunction with these problems associated with the authentication of security documents and the prevention of their counterfeiting, it is also essential to ensure that these security documents, subjected to various stresses over the course of their use, have a sufficiently long lifetime.

In particular, in the case of a banknote for example, it is necessary to take into account the fact that the banknote is frequently being handled, especially folded and unfolded repeatedly, which, if no modification of the fibrous structure has been envisioned in this regard, may result in rapid deterioration of said banknote, or even it tearing. This degradation may also result in degradation of the elements for authenticating said documents.

It may therefore be advantageous to introduce certain reinforcing materials into the fibrous layer.

However, sheet formation problems may appear when an excessively large amount of reinforcing material is added.

In particular, the Applicant has found that introducing synthetic fibers into a fibrous layer, for the purpose of increasing its mechanical strength, in fact degrades the quality and the rendition of a watermark formed within this layer.

Another object of the invention is therefore to propose a security paper that reconciles both correct and reliable security protection of said documents while still giving them mechanical or chemical resistance suitable for its normal use.

In this regard, the Applicant had the idea of using a papermaking technique employing several plies of fibrous material.

By assembling two paper layers coming from two separate forming plies, it is possible to obtain a multilayer fibrous structure, each layer corresponding to one ply of fibrous material, each ply having a specific pulp composition.

The advantage of this technique is that it allows each ply to be differentiated in terms of the desired properties for each of the layers of the paper.

By including different security elements on each of the faces of the paper, the level of security of said paper is also increased, given the greater difficulty for any counterfeiter to reproduce such a structure.

Thus, to solve the problem explained above in regard to the simultaneous presence within the same fibrous layer of two authentication elements or of an authentication element and a reinforcing element, especially if they are somewhat mutually incompatible, it is perfectly conceivable, using this technique, to separate these elements by positioning them in two different layers of the paper.

This means in fact that at least two plies of fibrous material are provided, in which the ply or plies having one of said elements does not include the other of said elements, and vice versa.

Apart from the fact of positioning the authentication or reinforcing elements in separate regions of the paper, this structure also has the advantage of limiting the consumption of said elements.

This is because, by distributing a given quantity of authentication elements on an external layer of a multilayer fibrous structure, it is found that the visual effect produced by these elements is enhanced over that produced when the same elements are added to a fibrous structure of the same weight, but comprising a single layer.

This enhancement may be explained by the greater density of accessible (in particular visible) authentication elements in the external layer of the multilayer structure compared with that of the single-layer structure.

This results statistically in a higher proportion of authentication elements flush with the surface of the paper or, at the very least, sufficiently close to this surface to be for example visible.

It is therefore easy to deduce therefrom that to obtain the same visual effect it will be necessary to have a smaller quantity of authentication elements in the case of the multilayer structure than in the case of a single-layer structure.

The present invention therefore consists of a security paper comprising at least two fibrous paper plies, the first ply being an external ply that includes at least one authentication element and the other ply, said second ply, comprising:

- a reinforcing element substantially absent from the first ply, said reinforcing element being chosen from materials that improve the mechanical strength; and/or
- another authentication element and the authentication element of said first ply being absent from said second ply.

According to a preferred embodiment of the invention, said reinforcing element is chosen from synthetic fibers, especially polyester or polyamide fibers, natural textile fibers, especially abaca, hemp, flax, Chinook fibers, and mixtures thereof.

In one particular case of the invention, said polyester fibers are polyethylene terephthalate (PET) fibers, more particularly they are present in an amount of between 10 and 20 parts by dry weight per 100 parts of the other fibers of said second ply.

According to one particular embodiment of the invention, said authentication element of the first ply, and where appropriate that of the second ply, can be detected optically.

According to one particular embodiment of the invention, at least one authentication element is chosen from watermarks, iridescent particles, luminescent, in particular fluorescent or phosphorescent, fibers or particles, colored or thermochromic fibers or particles, in particular said particles are planchettes.

According to another preferred embodiment of the invention, at least one authentication element reacts to certain stimulations, giving a specific signal that can be detected using a suitable apparatus.

According to one particular embodiment of the invention, at least one authentication element is chosen from substances that react to electromagnetic fields, in particular of the microwave type.

According to one particular case of the invention, one of the plies has a thickness substantially greater than that of a ply or of the other plies, preferably about 1.5 to 2 times greater.

According to one particular case of the invention, the external first ply includes a watermark as authentication element and has a thickness substantially greater than that of said second ply or of the other plies, preferably about 1.5 to 2 times greater. This is because, to have a high-quality watermark, one ply must be sufficiently thick.

According to a preferred case of the invention, the first ply has a watermark as authentication element and the second ply has said reinforcing element.

According to one particular case of the invention, said reinforcing element also has an authentication function. More particularly, said reinforcing element constitutes the authentication element of said second ply.

This is because said reinforcing element may for example be one of the aforementioned reinforcing fibers, which fiber would also has been treated so as to have in general electromagnetic and in particular luminescent properties, for example a magnetic or fluorescent fiber. It may for example be a polyester fiber, in particular a polyethylene terephthalate (PET) fiber that possesses a reactive (for example fluorescent) compound obtained by grafting or by addition during extrusion of the fiber. The fibers may also be specific metal fibers having a reinforcing and authentication function.

Preferably, the paper according to the invention includes a second ply containing said reinforcing element and said paper has a tear index of 10 $mN \cdot mg^2/g$ or higher.

According to one particular case of the invention, the plies are based (predominantly) on cotton fibers.

According to one particular case of the invention, the security paper is a banknote paper.

According to one particular case of the invention, the security paper comprises three fibrous plies, said external first ply having an authentication element, said second ply being central and having said reinforcing element, and the third ply being another external ply having an authentication element that may be different from that of said first ply.

The object of the invention is also to protect the process for obtaining said security paper, said plies being assembled wet.

The paper may for example be manufactured according to the manufacturing process comprising the following steps:

- at least a first ply of paper is formed on a first wet end of a paper machine, said first ply of paper being formed from a first pulp composition that includes an authentication element, in particular a watermark;
- at least a second ply of paper is formed on a second wet end of a paper machine, said second ply of paper being formed from a second pulp composition and containing at least one reinforcing element and/or authentication element, as described above, said element being absent from said first pulp composition and/or from said first ply;
- the two plies of paper are assembled so as to form a single multi-ply structure; and
- the multi-ply structure thus obtained is pressed and dried.

The paper may for example be formed on a cylinder-mold paper machine comprising two or more sheet-forming units, or one ply may be formed on a cylinder mold and another ply (or several other plies) on a former, or else the paper may be formed on a Fourdrinien multi-ply paper machine. When the paper includes a watermark, it is preferable to form the ply with the watermark on a cylinder mold with a watermark wire and the other ply (or the other plies, as the case may be) on a former.

DESCRIPTION OF PARTICULAR EMBODIMENTS

Figure 1:
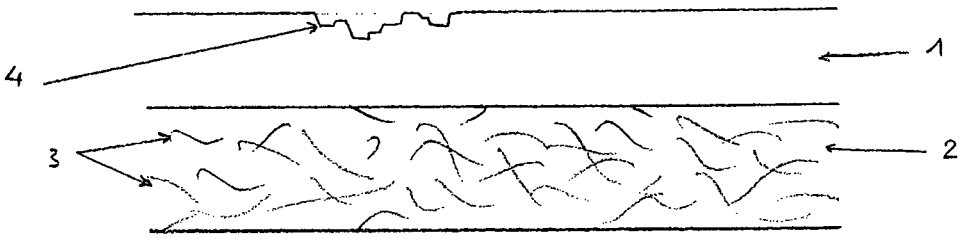
FIG. 1 is a schematic cross-section view of a two-ply paper according to the present invention.

FIG. 1 shows an illustrative embodiment of a two-ply paper according to the present invention, comprising a first ply 1 and a second ply 2. The second ply comprises reinforcing means in the form of synthetic fibers 3 such as PET, and the first ply comprises a watermark 4 as authentication element.

Figure 2:
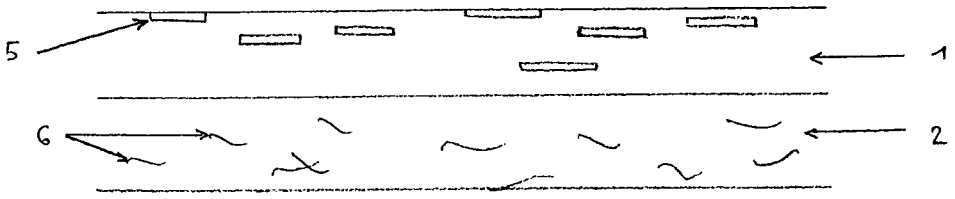
FIG. 2 is a schematic cross-section view of another two-ply paper according to the present invention.

FIG. 2 shows another illustrative embodiment of a two-ply paper according to the present invention, also comprising a first ply 1 and a second ply 2. The first ply comprises iridescent flakes 5 as authentication elements and the second ply comprises fluorescent fibers 6 as authentication elements.

The invention will be more clearly understood with the aid of the following examples.

Comparative Example 1

A series of watermarked paper sheets of square format and having an area of 310 $cm^2$ was produced from a fibrous composition containing, by dry weight, 100 parts of cotton fibers and 0.5 parts of red fluorescent planchettes, using a laboratory handsheet mold suitable for applying a watermark pattern in the thickness of the paper obtained.

The weight of the paper obtained was 85 $g/m^2$.

The fluorescent planchettes were only partly observable, some of them being buried too deep in the thickness of the paper.

Example 2

A first series of watermarked paper sheets of square format having an area 310 $cm^2$ was produced from a fibrous composition containing, as fibers, only cotton fibers, using a laboratory handsheet mold suitable for applying a watermark pattern in the thickness of the paper obtained.

The weight of the paper of this first series was 55 $g/m^2$.

Next, a second series of sheets of square format having an area of 310 $cm^2$ was produced from a fibrous composition containing, by dry weight, 100 parts of cotton fibers and 0.5 parts of red fluorescent planchettes, using a laboratory handsheet mold.

The weight of the paper of this second series was 30 $g/m^2$.

Next, a sheet of the first series and a sheet of the second series were assembled wet.

The complex obtained was dried.

Example 3

A first series of paper sheets of square format and having an area of 310 $cm^2$ was produced from a fibrous composition containing, by dry weight, 100 parts of cotton fibers and 0.5 parts of green fluorescent fibers using a laboratory handsheet mold.

The weight of the paper of this first series was 30 $g/m^2$.

A second series of sheets of square format having an area of 310 $cm^2$ was also produced from a fibrous composition containing, by dry weight, 100 parts of cotton fibers and 0.5 parts of red fluorescent planchettes, using a laboratory habdsheet mold.

The weight of the paper of this second series was 55 $g/m^2$.

Next, a sheet of the first series and a sheet of the second series were assembled wet.

The complex obtained was dried.

Tests Carried Out in Examples 1 to 3:

The number of fluorescent planchettes most clearly visible to the naked eye was counted while the papers obtained in Examples 1 to 3 were being illuminated with ultraviolet radiation.

Results of the Tests:

92 fluorescent planchettes were counted in Example 1, 120 fluorescent planchettes in Example 2 and 268 fluorescent planchettes in Example 3.

Likewise, in Example 3 the fluorescent planchettes and fibers were clearly observable.

Consequently, it is particularly advantageous to favor, for the same weight, the solution comprising a paper complex consisting of at least two different plies, each having the security elements.

Comparative Example 4

A series of watermarked paper sheets of square format having an area of 310 $cm^2$ was produced from a fibrous composition containing, by dry weight, 100 parts of cotton fibers using a laboratory handsheet mold suitable for applying a watermark pattern in the thickness of the paper obtained.

The weight of the paper obtained was 85 $g/m^2$.

Comparative Example 5

A series of watermarked paper sheets of square format having an area of 310 $cm^2$ was produced from a fibrous composition containing, as fibers, only cotton fibers and 12 parts of synthetic polyethylene terephthalate (PET) fibers as reinforcing fibers, using a laboratory handsheet mold suitable for applying a watermark pattern in the thickness of the paper obtained. The PET fibers had a length of 6 mm, a diameter of 12 μm and a tenacity of 1.4 dtex.

The weight of the paper obtained was 85 $g/m^2$.

Example 6

A first series of watermarked paper sheets of square format having an area of 310 $cm^2$ was produced from a fibrous composition containing, as fibers, only cotton fibers, using a laboratory handsheet mold suitable for applying a watermark pattern in the thickness of the paper.

The weight of the paper of this first series was 55 $g/m^2$.

A second series of sheets of square format having an area of 310 $cm^2$ was also produced from a fibrous composition containing, by dry weight, 100 parts of cotton fibers and 12 parts of synthetic polyethylene terephthalate fibers that were used in Example 5, by means of a laboratory handsheet mold.

The weight of the paper of this second series was 30 $g/m^2$.

Next, a sheet of the first series and a sheet of the second series were assembled wet.

The complex obtained was dried.

Example 7

A first series of watermarked paper sheets of square format having an area of 310 $cm^2$ was produced from a fibrous composition containing, as fibers, only cotton fibers, using a laboratory handsheet mold suitable for applying a watermark pattern in the thickness of the paper.

The weight of the paper of this first series was 55 g/m$^2$.

A second series of sheets of square format having an area of 310 cm$^2$ was also produced, using a laboratory handsheet mold, from a fibrous composition containing, by dry weight, 100 parts of cotton fibers and 12 parts of fluorescent polyester fibers (PET fibers with the same characteristics as those used in Example 5) as reinforcing fibers and also acting as second authentication element.

The weight of the paper of this second series was 30 g/m$^2$.

A sheet of the first series and a sheet of the second series were then assembled wet.

The complex obtained was dried.

Tests Carried Out in Examples 4 to 6:

The mechanical strength of the paper in each of Examples 4 to 6 was firstly measured using standardized test.

Thus, the tear index of the papers obtained was measured according to the NF EN 21974 standard.

The double-fold resistance was also measured, according to the NF ISO 5626 standard.

The rendition of the watermark in each of Examples 4 to 6 was then assessed visually.

Test Results:

Table 1 below gives the results of the tests carried out in Examples 4 to 6.

This table shows that the mechanical strength of the paper increases when synthetic fibers are introduced into the fibrous composition, the best results being obtained in Example 6 corresponding to the two-ply paper.

It also shows that the rendition of the watermark increases when the paper is made from two separate plies, one containing the synthetic reinforcing fibers and the other the watermark pattern, as in Example 6.

TABLE 1

| | Comparative Example 4 | Comparative Example 5 | Example 6 |
|---|---|---|---|
| Tear index (in mN · m$^2$/g) | 6.9 | 9.7 | 10.2 |
| Double fold | 2769 | 6722 | 7013 |
| Watermark rendition | good | mediocre | good |

The invention claimed is:

1. A security paper comprising at least first and second fibrous paper plies, wherein the first ply is a first material layer having a first fibrous structure comprising first fibers made of a first material, and the second ply is a second material layer having a second fibrous structure comprising second fibers made of a second material, the first ply being an external ply that includes a first authentication element provided within a region of non-zero thickness of the first ply, said first authentication element comprising at least one of (i) first authentication particles made of a third material, and (ii) first authentication fibers made of a fourth material different from the first material of the first fibers of the first fibrous structure of the first ply, and the second ply comprising a second authentication element provided within an area of non-zero thickness of the second ply, said second authentication element comprising at least one of (i) second authentication particles made of a fifth material, and (ii) second authentication fibers made of a sixth material different from the second material of the second fibers of the second fibrous structure of the second ply, wherein each of the third, fourth, fifth and sixth materials of the first and second authentication elements is selected from the group consisting of iridescent particles, luminescent fibers, luminescent particles, fluorescent fibers, fluorescent particles, phosphorescent fibers, phosphorescent particles, colored fibers, colored planchettes, thermochromic fibers, thermochromic particles, fibers that react to electromagnetic fields, and particles that react to electromagnetic fields, wherein the third material of the first authentication element is different from the fifth material of the second authentication element, and the fourth material of the first authentication element is different from the sixth material of the second authentication element, and wherein (1) the first ply does not include any authentication element made of any of the fifth and sixth materials, and (2) the second ply does not include any authentication element made of any of the third and fourth materials.

2. The security paper as claimed in claim 1, wherein the second authentication element of the second ply can be detected optically.

3. The security paper as claimed in claim 1, wherein said second ply comprises a reinforcing element, and said reinforcing element also has an authentication function.

4. The security paper as claimed in claim 3, wherein said reinforcing element constitutes said second authentication element of said second ply.

5. The security paper as claimed in claim 1, which comprises a third ply having a reinforcing element, wherein the third ply is central and the second ply is another external ply.

6. The security paper as claimed in claim 1, which is a banknote paper.

7. The security paper as claimed in claim 1, wherein said plies have been assembled wet.

8. A process for manufacturing a security paper as claimed in claim 1, comprising assembling said plies wet.

9. The security paper as claimed in claim 1, wherein at least one of said first and second authentication element is chosen from substances that react to electromagnetic fields of the microwave type.

10. The security paper as claimed in claim 1, wherein at least one of the first and second authentication elements comprises planchettes.

11. The security paper as claimed in claim 1, wherein each of said first and second authentication elements is selected from the group consisting of iridescent particles, luminescent fibers, luminescent particles, fluorescent fibers, fluorescent particles, phosphorescent fibers, phosphorescent particles, colored fibers, thermochromic fibers, thermochromic particles, fibers that react to electromagnetic fields, particles that react to electromagnetic fields.

12. The security paper as claimed in claim 1, wherein the first fibers and the second fibers are cotton fibers, and wherein each of said first and second authentication elements is selected from synthetic colored fibers, abaca fibers, hemp fibers, flax fibers, and Chinook fibers.

13. A security paper comprising at least first and second fibrous paper plies, wherein the first ply is a first material layer having a first fibrous structure comprising first fibers made of a first material, and the second ply is a second material layer having a second fibrous structure comprising second fibers made of a second material, the first ply being an external ply that includes a first authentication element provided within a region of non-zero thickness of the first ply, said first authentication element being a watermark, and the second ply comprising a reinforcing element, said reinforcing element being third fibers, wherein the third fibers are made of a third material different from the second material of the second fibers of the second fibrous structure of the second ply, said reinforcing element being selected from the group consisting of synthetic fibers, natural textile fibers, and mixtures thereof, wherein the third material of the third fibers of the reinforcing element is selected so that the paper has a mechanical strength higher than a mechanical strength of a paper having identical weight in $g/m^2$ and identical composition except without the reinforcing element, and wherein (1) the first ply does not include any reinforcing fibers made of a material different from the first material of the first fibers of the first fibrous structure of the first ply and such that the paper would have a mechanical strength higher than a mechanical strength of a paper having identical weight in $g/m^2$ and identical composition except without the reinforcing element, and (2) the second ply does not include any watermark.

14. The security paper as claimed in claim 13, wherein the reinforcing element is chosen from polyester fibers, polyamide fibers, abaca, hemp, flax, Chinook fibers, and mixtures thereof.

15. The security paper as claimed in claim 13, wherein the reinforcing element is chosen from polyester fibers, said polyester fibers are polyethylene terephthalate fibers, and said polyester fibers are present in an amount of between 10 and 20 parts by dry weight per 100 parts of the other fibers of said second ply.

16. The security paper as claimed in claim 13, wherein the second ply comprises a second authentication element.

17. The security paper as claimed in claim 16, wherein said second authentication element is selected from the group consisting of iridescent particles, luminescent fibers, luminescent particles, fluorescent fibers, fluorescent particles, phosphorescent fibers, phosphorescent particles, colored fibers, colored particles, thermochromic fibers, thermochromic particles, fibers that react to electromagnetic fields, particles that react to electromagnetic fields, and mixtures thereof.

18. The security paper as claimed in claim 13, wherein said external first ply has a thickness substantially greater than that of said second ply.

19. The security paper as claimed in claim 13, wherein said reinforcing element also has an authentication function.

20. The security paper as claimed in claim 13, wherein said security paper has a tear index of 10 $mN \cdot m^2/g$ or higher.

21. The security paper as claimed in claim 13, wherein the fibers of the fiber structures of the plies are cotton fibers.

22. The security paper as claimed in claim 13, which comprises a third ply having an authentication element, wherein the second ply is central and the third ply is another external ply.

23. The security paper as claimed in claim 13, which is a banknote paper.

24. The security paper as claimed in claim 13, wherein said plies have been assembled wet.

25. The security paper as claimed in claim 13, wherein said external first ply including the watermark has been formed on a cylinder-mold machine that includes a watermark wire.

26. A process for manufacturing a security paper as claimed in claim 13, comprising assembling said plies wet.

27. The process for manufacturing a security paper as claimed in claim 26, wherein said external first ply including the watermark is formed on a cylinder-mold machine that includes a watermark wire.

28. The security paper as claimed in claim 1, wherein the first fibers and the second fibers are cotton fibers, and wherein each of said first and second authentication elements is selected from the group consisting of iridescent particles, luminescent fibers, luminescent particles, fluorescent fibers, fluorescent particles, phosphorescent fibers, phosphorescent particles, synthetic colored fibers, colored planchettes, thermochromic fibers, thermochromic particles, fibers that react to electromagnetic fields, particles that react to electromagnetic fields.

* * * * *